US005203429A

United States Patent [19]

Zager

[11] Patent Number: 5,203,429

[45] Date of Patent: Apr. 20, 1993

[54] MOTORIZED OIL CHANGING SYSTEM

[75] Inventor: Raymond Zager, Ponte Vedra Beach, Fla.

[73] Assignee: Ray Zager & Company, Ponte Vedra Beach, Fla.

[21] Appl. No.: 862,724

[22] Filed: Apr. 3, 1992

[51] Int. Cl.[5] ..... F16N 33/00

[52] U.S. Cl. ..... 184/1.5; 184/105.1; 123/196 R

[58] Field of Search ..... 184/1.5, 105.1, 6.4, 184/6.12; 123/196 R, 196 S; 137/613

[56] References Cited

U.S. PATENT DOCUMENTS 2,160,741 5/1939 Jensen et al. ..... 184/1.5
3,720,287 3/1973 Martel ..... 184/1.5
4,012,012 3/1977 Ligler ..... 123/196 S
4,240,523 12/1980 Nestor et al. ..... 184/1.5
4,951,784 8/1990 Bedi ..... 184/1.5

*Primary Examiner*—Ira S. Lazarus
*Assistant Examiner*—Alan B. Cariaso
*Attorney, Agent, or Firm*—Arthur G. Yeager

[57] ABSTRACT

A system for draining and filling oil reservoirs in the crankcases and the transmissions of vehicles with two or more engines, including a motor driver pump, conduits connecting the pump to the crankcases and transmissions of each engine, the generator, and an oil sump; and selector valves to connect the conduits to the pump in a variety of combinations.

12 Claims, 2 Drawing Sheets

MOTORIZED OIL CHANGING SYSTEM

BACKGROUND OF THE INVENTION

1. Field of the Invention

This invention relates to engine maintenance equipment and more particularly to a motorized system for draining and refilling crankcase oil and maintaining the oil at operating levels for use as a permanent installation in twin engine boats and, in simplified form, in automobiles and trucks, and having safety lock capability for the controls.

2. Prior Art

Changing the oil in boats having inboard engines presents difficulty because of tight quarters and the inaccessibility of the oil drains often requiring boat owners to employ high cost maintenance personnel having special equipment to change the oil. While electric motor driven pumps powered by storage batteries and adapted to accomplish a wide variety of jobs are well known in the art, there is a present need for a simple, practical and efficient device, not presently available, to alleviate boat owners of the messy, tedious and often expensive chore of changing oil and maintaining proper oil levels between oil changes.

Various devices have been suggested for aiding the automobile and truck owner in oil changing including dashboard mounted controls for operating special drain plug valves to obviate getting beneath the vehicle to remove the drain plug and various pump arrangements used in connection with such valves for removing the oil. However, there appears to be a need for a simple battery powered motor driven pump having all the controls including a safety lock in a self-contained. unit which will be easy to install under the hood as a permanent accessory to enable the individual owner to effectively and efficiently handle the old and the new oil.

In my patent (U.S. Pat. No. 4,240,523) there is described and claimed a system for changing the oil in the crankcases of boats having two or more engines. It is also required that the transmission oil be changed from time to time. There are no motorized systems available in the market today to accomplish the draining and refilling of both crankcase oil and transmission oil, as well as supplying oil to other mechanisms, such as a generator.

It is an object of this invention to provide a motorized system for draining and refilling oil lubrication vessels on a plurality of engines that can be controlled from one central location. It is another object of this invention to provide a system for use on boats having twin engines, the system providing means for draining and refilling oil reservoirs in engines and other mechanisms by operating controls at a central convenient location. Still other objects will be apparent from the more detailed description which follows.

BRIEF SUMMARY OF THE INVENTION

This invention relates to a system for draining and refilling the crankcase oil from a plurality of engines wherein the system includes a reversible pump driven by an electric motor and a three-position electric switch to selectively control the motor to an "off" position, a "forward" pumping direction, and a "reverse" pumping direction. The flow of oil is selectively directed through a selector valve and conduits to and from any of three locations; namely, a first engine, a second engine, and a generator. Incorporated in the conduit between the selector valve and generator is a second selector valve and conduits to direct oil flow to and from any of three locations; namely a first engine transmission, a second engine transmission, and the generator.

In specific embodiments of this invention the system is operated on a boat having twin engines.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE DRAWINGS

The system of this engine has as its basic form that shown in U.S. Pat. No. 4,340,523 and the specification and drawings of that patent are incorporated herein by reference to supplement this description, wherever needed.

Figure 1:
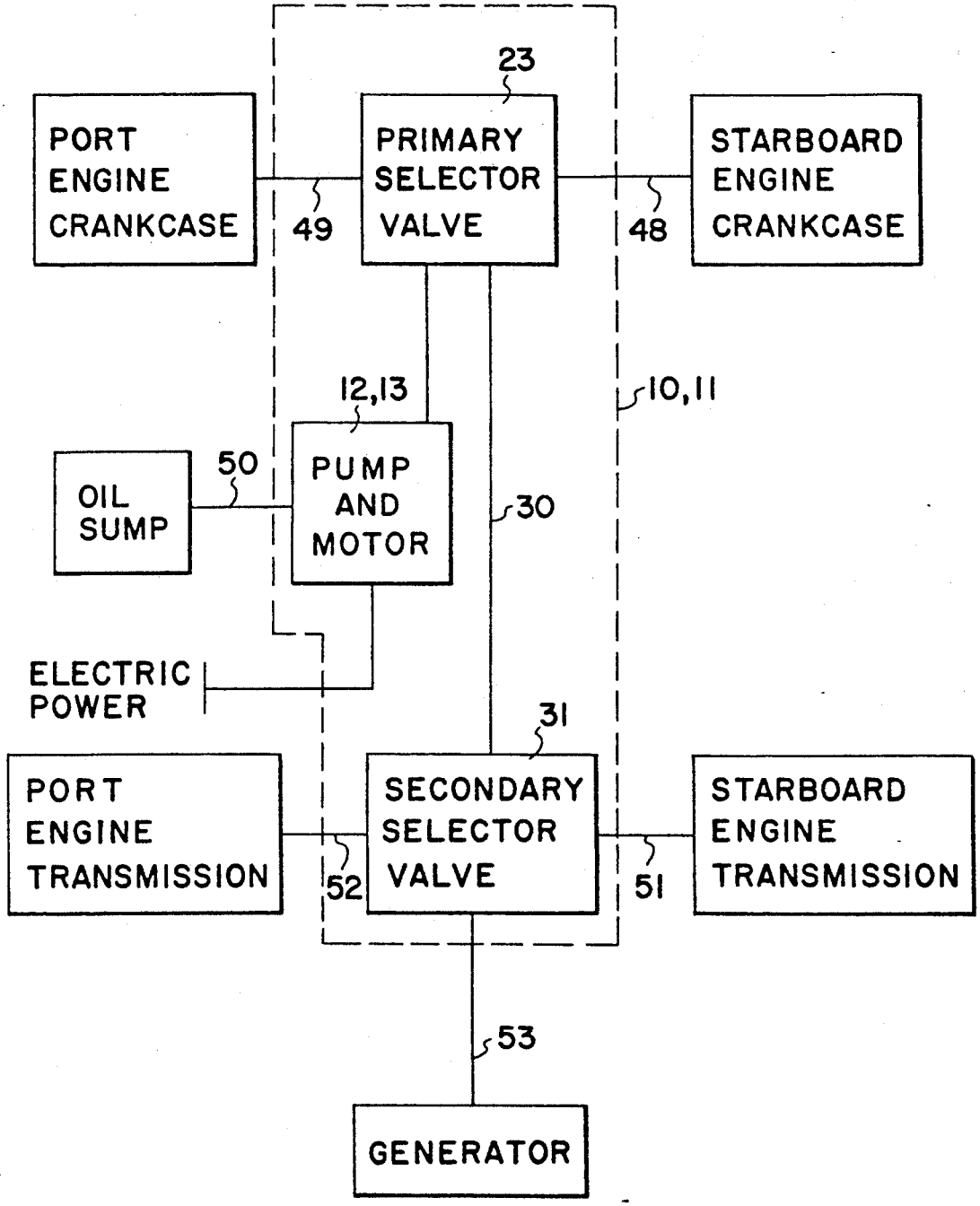
FIG. 1 is a schematic block diagram of the system of this invention as applied to a boat having two engines and a generator.

The block diagram of FIG. 1 shows the general system of this invention involving port and starboard engines and a generator. The central control unit is shown in dotted lines as involving a housing having a base 10 and a cover 11. Enclosed in the housing is a pump 12, driven by a reversible electric motor 13, two selector valves 23 and 31, and the conduit 30 connecting the two valves 23 and 31. Leading out of the housing are conduits 48, 49, 50, 51, 52 and 53 connecting the valves 23 and 31 to the components needing lubrication, e.g. the crankcase of each engine, the transmission of each engine, and the generator. An oil sump is one component connected to the system to provide of reservoir into which used oil may be drained and also a reservoir from which fresh oil may be pumped to any other location in the system.

Figure 2:
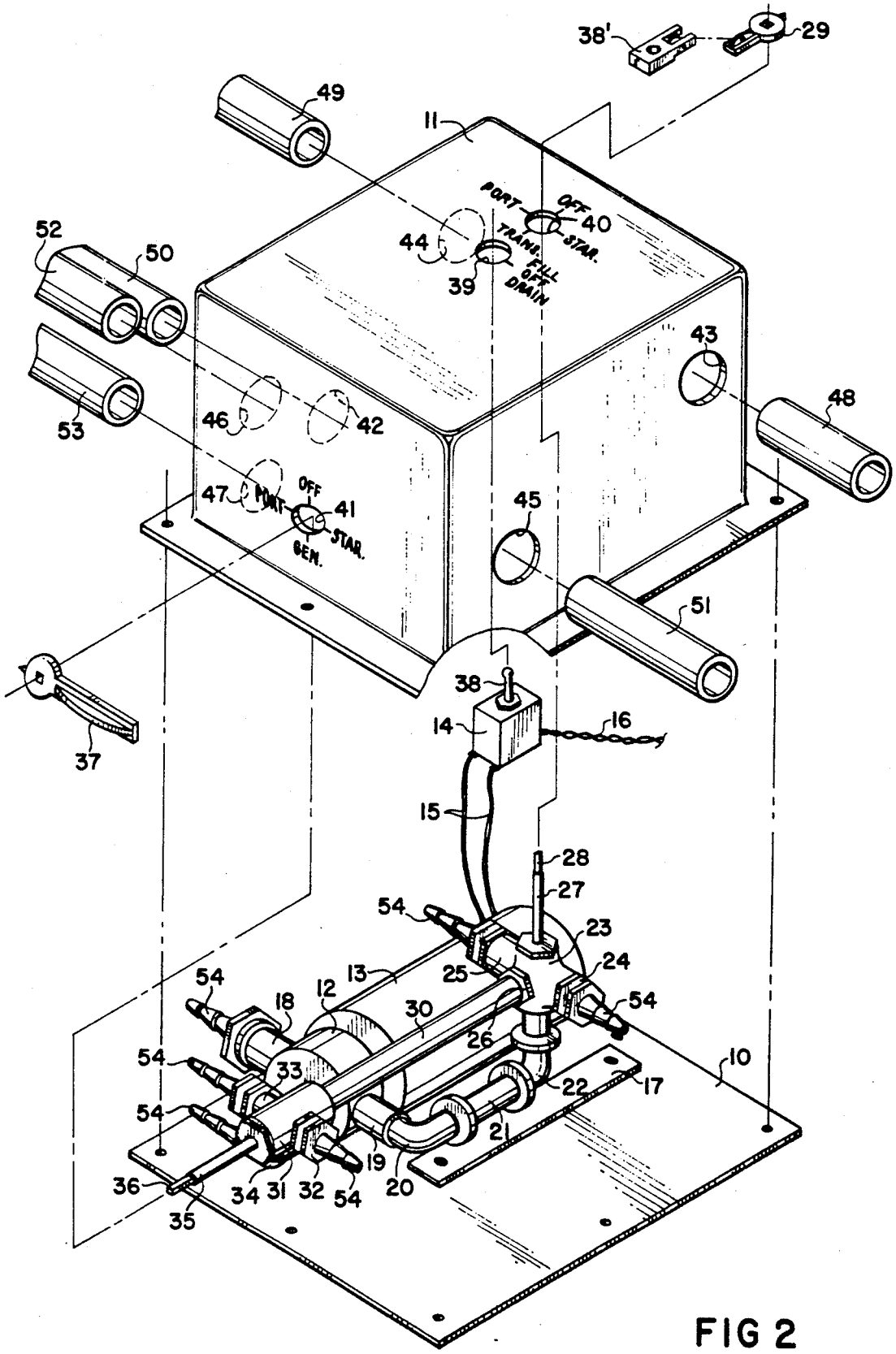
FIG. 2 is an exploded perspective view of a central control unit having a pump, a motor, two selector valves and the means for operating the system t drain and fill oil reservoirs in two engines and a generator.

In FIG. 2 there is shown an illustration of how the various components of the system are assembled for operation.

Pump 12 and motor 13 are mounted on base 10 and housed under cover 11. Pump 12 has a suction port 18 and an outlet port 19. Since motor 13 and pump 12 are reversible ports 18 and 19 are also reversible. Nevertheless, for simplicity of description port 18 will be considered the suction port and is connected via conduit 50 to the oil sump (see FIG. 1). Thus in its forward operation oil is drawn from the sump into pump 12 through port 18 and is pumped outwardly under pressure through port 19 to its selected destination.

Outlet port 19 is connected via first elbow 20, pipe nipple 21, and second elbow 22 into first, or primary, selector valve 23. This valve has three exits which are available to the operator by turning control rod 27 to the appropriate direction. Control rod 27 extends upwardly through hole 40 in cover 11. A manually operated handle 29 fits over square end 28, and preferably fixed in place by a set screw or other means (not shown). The pointer on handle/lever 29 can be turned to any of four positions shown on cover 11 to be "off" at 12 o'clock "starboard" at 3 o'clock, "transmission" at 6 o'clock, and "port" at 9 o'clock. These, respectively, close the valve, direct the flow to the starboard engine crankcase, direct the flow to second selector valve 31 (which, in turn, directs flow to transmission), and direct flow to the port engine crankcase. Each outlet 24 or 25 from valve 23 to the port or starboard engines includes an adaptor 54 which screws into the appropriate valve outlet and includes rubber tubing tip onto which a rubber tube 48 or 49 is connected with the other end connected to the crankcase of the appropriate engine. Thus outlet 24 from valve 23 is connected via adapter 54 to tubing conduit 48, which, in turn, is connected to the crankcase of the starboard engine. Similarly, outlet 25 of valve 23 is connected via adapter 54 to tubing conduit 49 which, in turn, is connected to the crankcase of the port engine. It is to be understood that adapter 54 and tubing 48 or 49 may be replaced by rigid pipe conduit and fittings, if desired.

Outlet 26 from valve 23 is connected to a pipe nipple 30, which, in turn, is connected to second, or secondary selector valve 31, which also has three outlets 32, 33 and 34. Outlet 32 leads via adapter 54 and tubing conduit 51 to the starboard engine transmission. Outlet 33 leads via adapter 54 and tubing conduit 52 to the port engine transmission. Outlet 34 leads via adapter 54 and tubing conduit 53 to the generator, or alternatively, to any other mechanism needing periodic lubrication. Valve 31 is controlled by the turning of control rod 35, manipulated by handle lever 37 connected to square end 36 of rod 35 and held in place by a set screw means (not shown). It may be seen that control rod 35 extends outwardly of cove 11 through hole 41 where there are indexing marks to show the status of oil flow through valve 31 when the pointer of handle lever 37 indicates any of its four positions; namely "off" at 12 o'clock, "starboard engine transmission" at 3 o'clock, "generator" at 6 o'clock, and "port engine transmission " at 9 o'clock. As explained above the rubber hose conduits 51, 52 and 53 to the engine transmissions and to the generator may be replaced by rigid conduits and fittings, if desired. The outlet 34 to the generator may, instead, be directed to any other machine needing periodic oil changes.

Switch 14 is shown having a toggle switch handle 38 which extends upwardly through hole 39 in cover 11. The three positions of switch handle 38 are shown as "off", "drain", and "fill". "Off" means that no power is supplied to motor 13. Switch 14 is supplied with power through input lines 16 and directs that power to motor 13 through lines 16 and directs that power to motor 13 through lines 15. Since motor 13 is reversible the positions of "drain" and "fill" indicate forward and reverse operation of motor 13 and pump 12. The "drain" position causes oil to flow from any of tubing conduits 45, 48, 49, 51, 52 or 53 (which represent crankcases or transmissions of each engine and the generator) through tubing conduit 50 to the oil sump. The "fill" position denotes opposite flow direction; namely, from oil sump through tubing conduit 50 to any of the engine or generator tubing conduits 45, 48, 49, 51, 52 or 53.

My patent, U.S. No. 4,240,523 describes a safety locking mechanism connecting toggle switch handle 38 to valve handle lever 29 to prevent inadvertent starting of motor 13. That locking mechanism or any equivalent means may be usefully applied to this system for the same safety purposes.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. In a system for draining and refilling the oil from a plurality of engines wherein the system includes a reversible pump driven by an electric motor to an "off" position, a "forward" pumping direction, and a "reverse" pumping direction; the flow of oil being selectively directed through a first selector valve and then selectively through conduits therefrom to and from any of three locations wherein two of said three locations being crankcase a crankcase, a first engine and second engine; the improvement wherein the third location comprises a second selector valve, another conduit connected between said first and second selector valves, said second selector valve and additional conduits directing oil flow selectively to and from any of three additional locations being a first engine transmission, a second engine transmission, and a generator.

2. The system of claim 1 which includes a housing for said pump, said motor, said switch, said first selector valve, and said second selector valve.

3. The system of claim 1 which is adapted to control the lubrication of a pair of marine engines.

4. The system of claim 1 which additionally includes a temporary locking means engaging said switch in said "off" position until positive manual operations are taken to unlock said means.

5. In a system for draining and refilling oil from a plurality of engines wherein the system includes a reversible pump driven by an electric motor having a three-position electric switch to selectively control the motor to an "off" position, a "forward" pumping direction, and a "reverse" pumping direction, a first selector valve and conduits to control the flow of oil to and from any of "three" locations wherein two of said three locations being crankcase a first engine, and a second engine crankcase the improvement wherein the third location comprises a second selector valve in fluid communication with another conduit between first and second said selector valve, additional conduits connected to said second selector valve to direct oil flow to and from any of there additional locations being a first engine transmission, a second engine transmission, and a generator, said first selector valve controlling oil flow between said pump, and said first and second crankcases, engine and said second selector valve, said second selector valve controlling oil flow between said pump, and said first and second transmissions, and said generator only when said first selector valve selects said second selector valve in said one conduit.

6. The system of claim 5 which includes a housing for said pump, said motor, said switch, said first selector valve, and said second selector valve.

7. The system of claim 6 wherein said one conduit is located within said housing.

8. The system of claim 7 wherein said conduits other than said another conduit extend through openings in said housing.

9. The system of claim 6 wherein said first and second selector valves and switch each include a handle operable from outside said housing.

10. The system of claim 5 wherein said engines are marine engines.

11. The system of claim 5 which additionally includes locking means engaging said switch in said "off" position until positive manual operations are taken to unlock said locking means.

12. The system of claim 5 wherein each of said first and second selector valve, is a 3-way valve.

* * * * *